US007624473B2

(12) United States Patent
Kegg et al.

(10) Patent No.: US 7,624,473 B2
(45) Date of Patent: Dec. 1, 2009

(54) ADJUSTABLE FLOW RATE VALVE FOR A CLEANING APPARATUS

(75) Inventors: Steven W. Kegg, Uniontown, OH (US); Evan A. Gordon, Canton, OH (US)

(73) Assignee: The Hoover Company, North Canton, OH (US)

( * ) Notice: Subject to any disclaimer, the term of this patent is extended or adjusted under 35 U.S.C. 154(b) by 380 days.

(21) Appl. No.: 10/753,017

(22) Filed: Jan. 7, 2004

(65) Prior Publication Data

US 2005/0144751 A1 Jul. 7, 2005

(51) Int. Cl.
*A47L 11/30* (2006.01)

(52) U.S. Cl. ..... 15/320; 15/321

(58) Field of Classification Search ..... 15/320, 15/321

See application file for complete search history.

(56) References Cited

U.S. PATENT DOCUMENTS

| | | | | |
|---|---|---|---|---|
| 3,101,505 | A | 8/1963 | Belicka et al. | |
| 3,444,577 | A | 5/1969 | Koland | |
| 3,533,120 | A | 10/1970 | De Mercado | |
| 4,558,823 | A | 12/1985 | Groth | |
| 4,845,801 | A | 7/1989 | Milly et al. | |
| 4,881,288 | A * | 11/1989 | May et al. | 15/98 |
| 4,956,891 | A | 9/1990 | Wulff | |
| 5,045,068 | A | 9/1991 | Kawai et al. | |
| 5,398,567 | A | 3/1995 | Specht | |
| 5,901,745 | A | 5/1999 | Buchtel | |
| 5,937,475 | A | 8/1999 | Kasen et al. | |
| 6,016,973 | A | 1/2000 | Thompson et al. | |
| 6,158,081 | A | 12/2000 | Kasen et al. | |
| 6,247,202 | B1 | 6/2001 | Lesco et al. | |
| 6,301,738 | B1 * | 10/2001 | Deiterman et al. | 15/50.1 |
| 6,880,199 | B1 * | 4/2005 | Huffman et al. | 15/320 |
| 2001/0022010 | A1 * | 9/2001 | Kasper | 15/320 |
| 2003/0226230 | A1 | 12/2003 | Hertrick et al. | |

FOREIGN PATENT DOCUMENTS

| | | |
|---|---|---|
| CN | 1047978 | 12/1990 |
| CN | 2579439 | 10/2003 |

OTHER PUBLICATIONS

CN patent #2579439, filed Oct. 15, 2003.
CN Ex Action citing same, filed Jul. 20, 2007.

* cited by examiner

*Primary Examiner*—David A Redding

(57) ABSTRACT

A portable cleaning apparatus for cleaning a surface is provided and includes a housing for movement along the cleaning surface. A solution distribution system is mounted at least in part to the housing and includes a solution distributor operatively connected to the housing for distributing a solution onto the cleaning surface, a first solution tank for holding the solution, and a first adjustable flow rate valve fluidly connected between the first solution tank and the distributor for adjusting the flow rate of the solution out of the valve.

15 Claims, 7 Drawing Sheets

ADJUSTABLE FLOW RATE VALVE FOR A CLEANING APPARATUS

BACKGROUND OF THE INVENTION

1. Field of the Invention

The present invention relates to an adjustable flow rate valve for a cleaning apparatus.

2. Background Information

It is known to have cleaning machines such as carpet extractors that distribute cleaning solution composed of detergent mixed with water to wash the cleaning surfaces. Some extractors can also distribute cleaning solution composed of clean water to rinse the cleaning surface in addition to cleaning solution composed of detergent mixed with water. Often, a clean water supply tank and a detergent supply tank are used for distributing either type of cleaning solution. Some cleaning machines further have mixing valves to selectively control the ratio of detergent and clean water in the cleaning solution. Such mixing valves are disclosed in U.S. Pat. Nos. 5,937,475 and 6,158,081. Yet, this valve is complicated in design, requiring a number of parts. Further, It would be desirable to provide a valve or valve system on a cleaning machine that can adjust the flow rate of the fluid distributed on the surface in addition to controlling the ratio of detergent and water.

Hence, it is an object the present invention to provide a simple valve or device that adjusts the flow rate of fluid from a cleaning machine.

SUMMARY OF THE INVENTION

The foregoing and other objects of the present invention will be readily apparent from the following description and the attached drawings. In one aspect of the invention, a portable cleaning apparatus for cleaning a surface is provided and includes a housing for movement along the cleaning surface. A solution distribution system is mounted at least in part to the housing and includes a solution distributor operatively connected to the housing for distributing a solution onto the cleaning surface, a first solution tank for holding the solution, and a first adjustable flow rate valve having an inlet fluidly connected to the first solution tank and an outlet fluidly connected to the distributor for adjusting the flow rate of the solution out of the distributor. The first adjustable flow rate valve has a rotating valve part with a variable flow rate groove positioned between the inlet and the outlet. A knob is secured to the valve part, wherein rotating the knob rotates the valve part and the slot such that the flow rate through the first adjustable flow rate valve is dependent on the position of the slot between the inlet and the outlet of the valve part.

In another aspect of the invention, a portable cleaning apparatus for cleaning a surface is provided and includes a housing for movement along the cleaning surface. A solution distribution system is mounted at least in part to the housing and includes a solution distributor operatively connected to the housing for distributing a solution onto the cleaning surface and includes a solution tank for holding the solution, a first adjustable flow rate valve having a valve part operatively associated with the first solution tank and the distributor for adjusting the flow rate of the solution out of said distributor, and a second adjustable flow rate valve having a valve part operatively associated with the first solution tank and the distributor for adjusting the flow rate of the solution out of the distributor. A user operated selector operatively connected to the valve part of the first adjustable flow rate valve, wherein moving the selector moves the valve part such that the flow rate of the solution through said first adjustable flow rate valve is dependent on the position of the valve part of the first adjustable flow rate valve. A coupling member is operatively connected between the valve part of the second adjustable flow rate valve and one of the selector and the valve part of the first adjustable flow rate valve such that movement of the selector causes the coupling member to move the valve part of the second adjustable flow rate valve such that the flow rate of the solution through the second adjustable flow rate valve is dependent on the position of the valve part of the second adjustable flow rate valve.

In another aspect of the invention, a portable cleaning apparatus for cleaning a surface is provided and includes a housing for movement along the cleaning surface. A solution distribution system is mounted at least in part to the housing and includes a solution distributor operatively connected to the housing for distributing a solution onto the cleaning surface and includes a first solution tank for holding a first solution, a second solution tank for holding a second solution, a mixing chamber fluidly connected between the first and second solution tanks for mixing the first and second solutions, a first adjustable flow rate valve having a valve part operatively associated with the mixing chamber and the distributor for adjusting the flow rate of the solution out of the mixing chamber, and a second adjustable flow rate valve operatively associated with the first solution tank and the mixing chamber for adjusting the flow rate of the first solution from the first solution tank and thereby varying the relative proportions of the first solution and the second solution flowing out of the mixing chamber.

BRIEF DESCRIPTION OF THE DRAWINGS

The invention will now be described, by way of example, with reference to the attached drawings, of which.

DETAILED DESCRIPTION OF THE INVENTION

Figure 1:
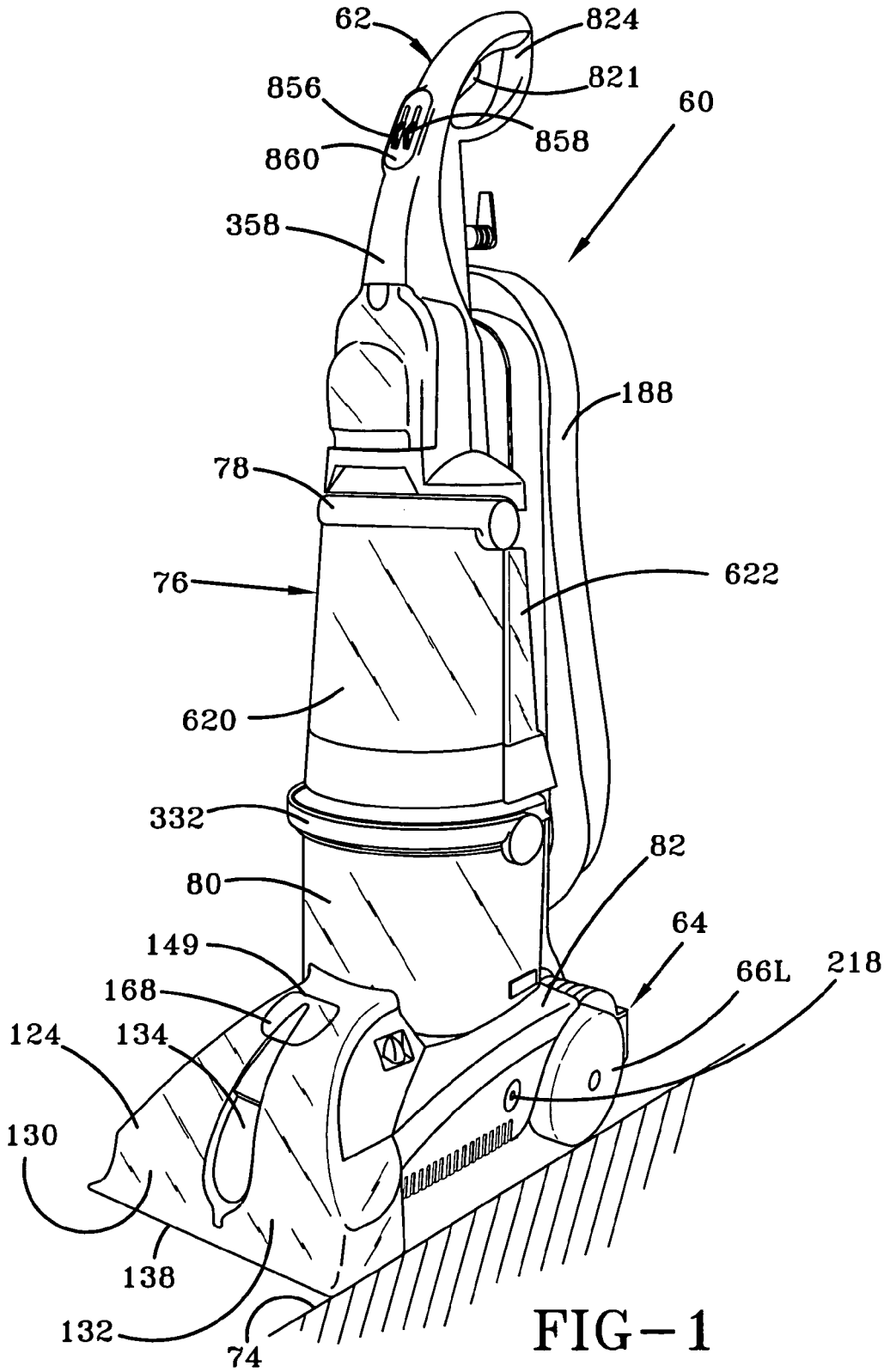
FIG. 1 is a perspective view of a carpet extractor embodying the present invention.

Referring to the drawings, FIG. 1 depicts a perspective view of an upright carpet extractor 60 according to one embodiment of the present invention. The upright carpet extractor 60 comprises an upright handle assembly 62 pivotally connected to the rear portion of the floor-engaging portion or base assembly 64 that moves and cleans along a surface 74 such as a carpet.

A supply tank assembly 76 is removably mounted to the handle portion 62 of the extractor 60 and includes a combination carrying handle and securement latch 78 pivotally connected thereto. A combined air/water separator and recovery tank 80 removably sets atop base assembly 64 and is surrounded by a hood portion 82. The base assembly 64 includes two laterally displaced wheels 66 (only the left wheel 66L being shown) rotatably attached thereto. A combined air/water separator and recovery tank 80 with carrying handle 332 removably sets atop a motor/fan assembly 90 (FIG. 3 from co pending application having Ser. No. 10/165,731 and publication no. 20030226230; the disclosure being incorporated herein by reference) of base assembly 64 and is surrounded by a hood portion 82. A floor suction nozzle assembly 124 is removably mounted to the hood portion 82 of the base assembly 64 and in fluid communication with the recovery tank 80 for transporting air and liquid into the recovery tank 80. The floor suction nozzle assembly 124 includes a front plate secured to a rear plate that in combination define dual side ducts 130,132 separated by a tear drop shaped opening 134.

Figure 2:
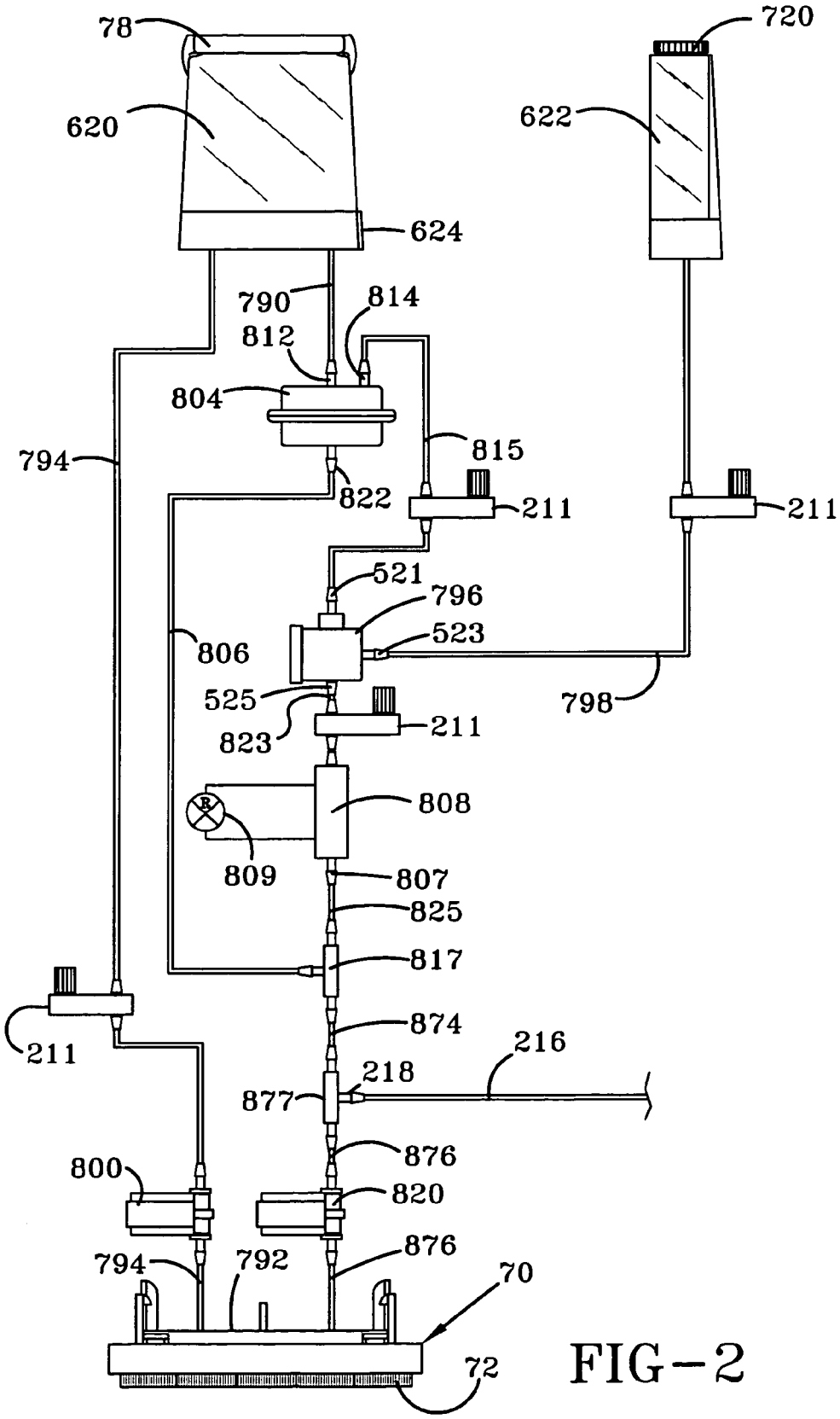
FIG. 2 is a schematic view of the fluid distribution system of the embodiment shown in FIG. 1.

As depicted in FIG. 2, the base assembly 64 includes a brush assembly 70 having a plurality of rotating scrub brushes 72 for scrubbing the surface. A suitable brush assembly 70 is taught in U.S. Pat. No. 5,867,857, the disclosure which is incorporated herein by reference. Brush assembly 70 is operated by a suitable gear train (or other known means). A suitable air turbine driven gear train is taught in U.S. Pat. No. 5,443,362, the disclosure of which is incorporated by reference. Other brush assemblies could be used such as, for example, a horizontal brush roll or fixed brush assembly.

The supply tank assembly 76 comprises a clean water supply tank 620 and a detergent supply tank 622 with cap 720 (FIG. 2) adhesively mounted to the clean water supply tank 620 as depicted in FIG. 1. The supply tank assembly 76 includes a combination carrying handle and tank securement latch 78 providing a convenient means for carrying the tank and/or securing the tank to the extractor handle assembly 62. The supply tank assembly 76 is positioned upon a bottom base 624, which with the tank assembly 76 is removably mounted to the handle.

FIG. 2 illustrates the overall solution distribution system, which will be described below. The carpet extractor 60 includes a solution hose 794 that fluidly connects the outlet of the clean water tank 620 to a shut off valve 800 used for selectively turning on and off the flow of clean water. An adjustable flow rate valve 211 is provided in the solution hose 794 and in fluid communication with the clean water tank 620 and shut off valve 800. Another solution hose 790 fluidly connects the outlet of the water tank 620 to an inlet 812 of a pressure actuated shut off valve 804. The outlet of the detergent tank 622 is fluidly connected to inlet 523 of a mixing Tee 796 via a suitable flexible solution hose 798. An adjustable flow rate valve 211 is provided in the solution hose 798 and in fluid communication with the mixing Tee 796 and detergent tank 622. Further details of the valve 211 will be described later.

The pressure actuated shut off valve 804 is fluidly connected between the clean water tank 620 and the mixing Tee 796 for turning off and on the flow of water. This shut off valve 804 is opened and closed by outside pressure via a conduit 806 connected between it and the outlet 807 of a pump 808 through a Tee 817. The valve 804 includes a pressure port 822 fluidly connected to the outlet 807 of a pump 808. The outlet of the valve 814 is fluidly connected to an inlet 521 of the mixing Tee 796 via hose 815. An adjustable flow rate valve 211 is provided in the solution hose 815 and in fluid communication with the mixing Tee 796 and pressure actuated shut off valve 804. It should be known that clean water tank 620 could be fluidly connect to the outlet 814 of the valve 804 with the inlet 812 of the valve 804 being fluidly connect to the mixing Tee 796 so that fluid could flow the opposite direction if desired.

In operation, when the pressure at the pressure port 822 is below a predetermined value such as between 7 to 10 psi, the valve 804 opens to allow water to flow in both directions. Such a pressure value at the pressure port 822 occurs when the main shut off valve 820 is opened and the pump 808 is turned on. The pump 808 also pressurizes the water containing the dissolved fragrance tablet mixed with detergent to draw it to the distributor 792. When the pressure exceeds a second predetermined value such as between 20 to 30 psi, the valve 804 closes. This would occur if the main shut off valve 820 is closed and the pump is turned on. Thus, with the valve 804 closed, the cleaning solution is prevented from flowing through it. Various types of pumps can be used such as a piston pump, gear pump or centrifugal pump.

Outlet 525 of the mixing Tee 796 is fluidly connected via flexible solution hose 823 to the inlet of the pump 808, which provides pressure to draw the cleaning solution to the distributor 792, when it is turned on. An adjustable flow rate valve 211 is provided in the solution hose 823 and in fluid communication with the mixing Tee 796 and pump 808. A relief valve 809 is fluidly connected across the pump 808 to limit the pressure at the outlet 807 of the pump 808 to a predetermine value. The outlet 807 of the pump 808 is fluidly connected to the main shut off valve 820 via flexible hoses 825, 874 and 876. Both of the shut off valves 800, 820 are in the form of a solenoid valve, however, other electrical actuated valves could be also used.

Figure 3:
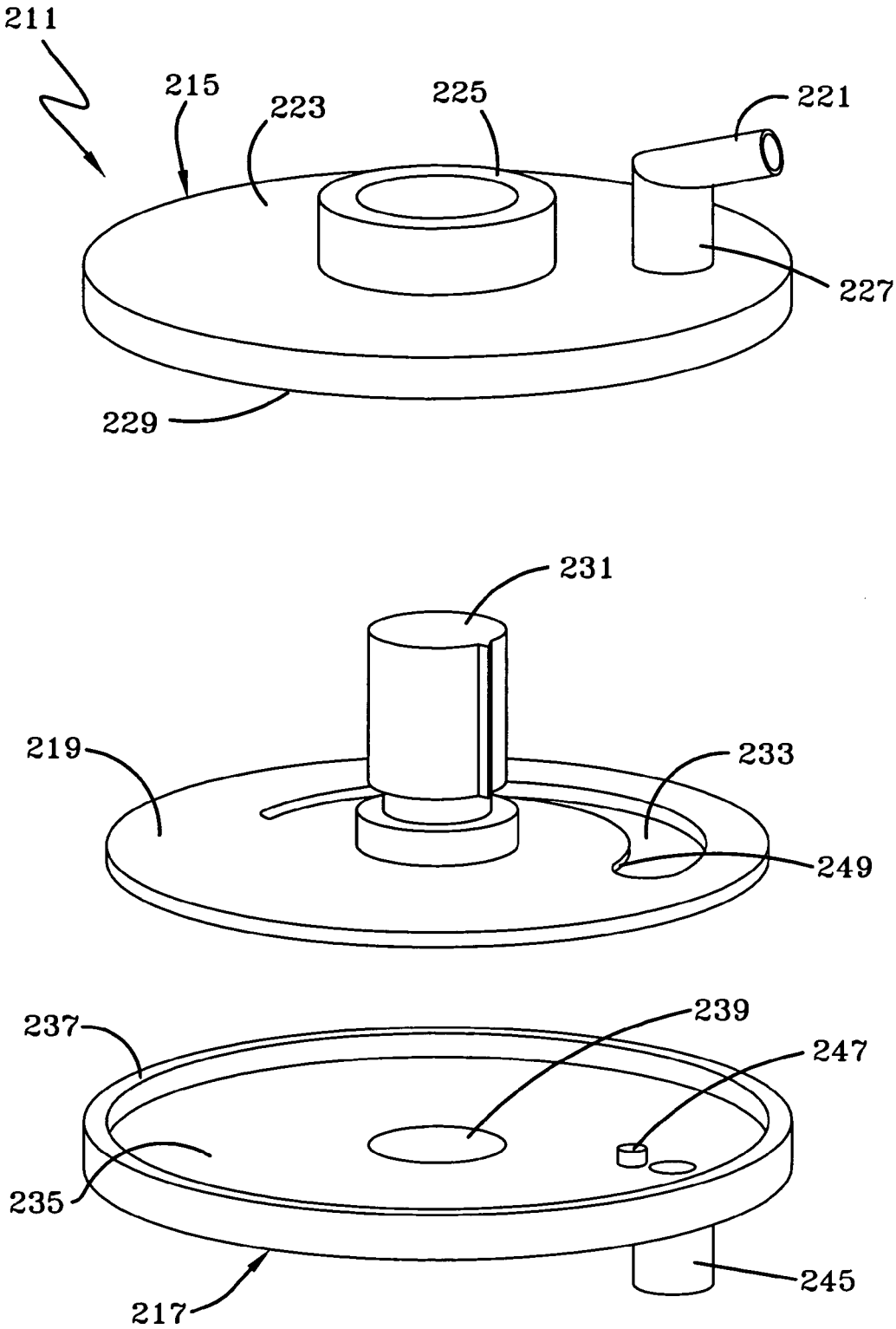
FIG. 3 is an exploded view of the adjustable flow rate valve of the carpet extractor illustrating the elements thereof.
Figure 4:
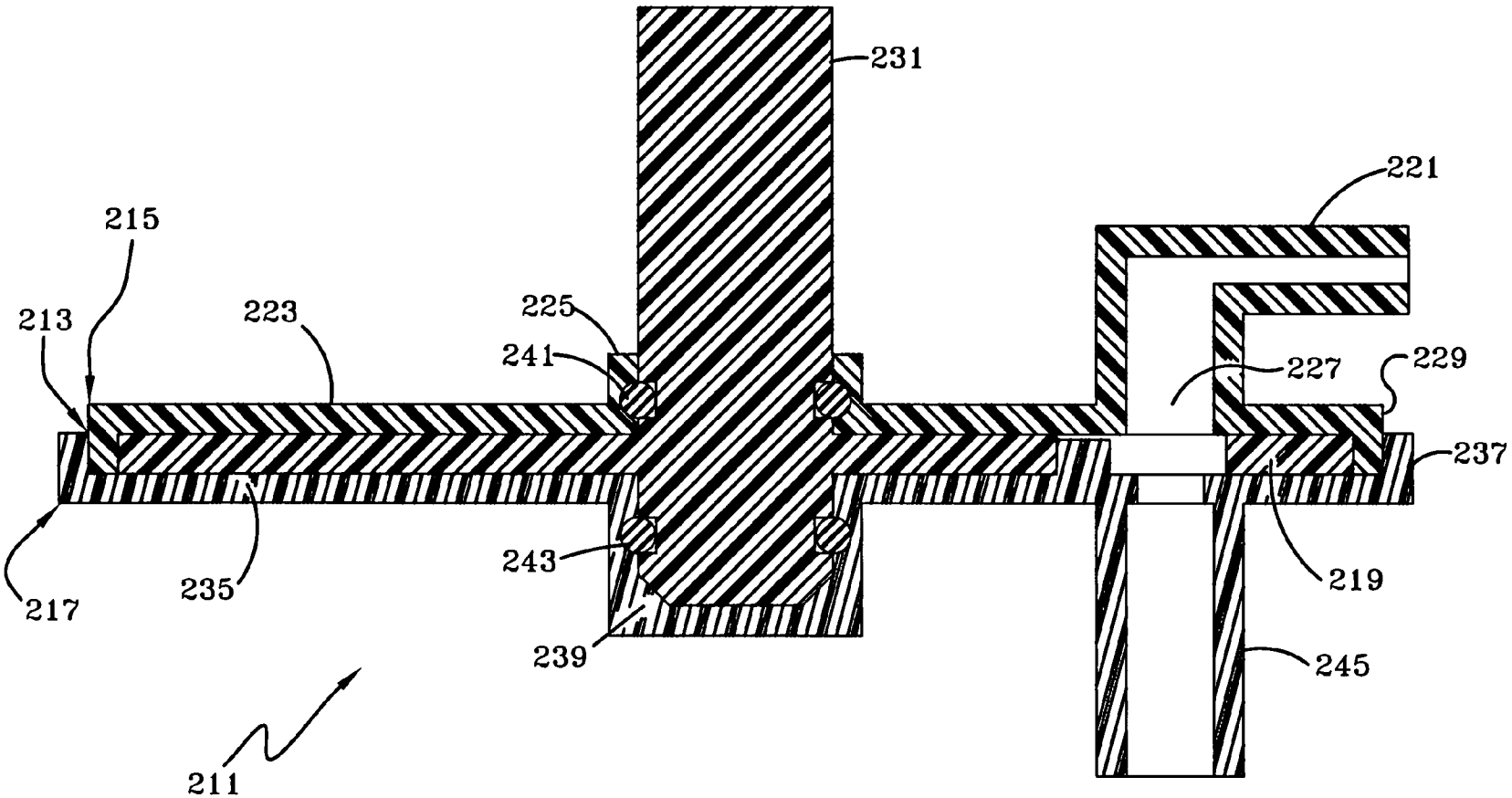
FIG. 4 is a cross sectional view of the adjustable flow rate valve of FIG. 3.
Figure 6:
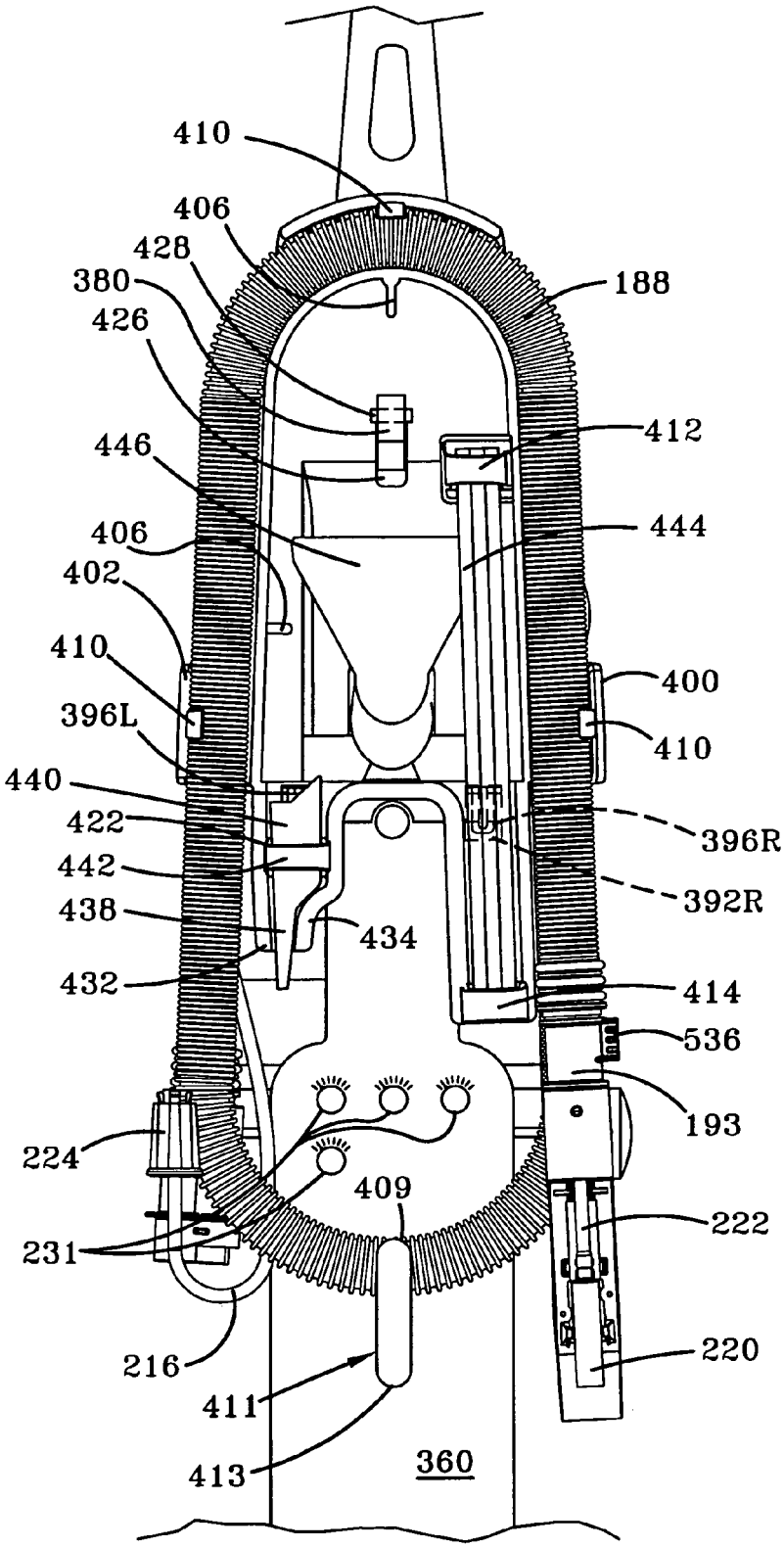
FIG. 6 is a partial rear elevational view of the carpet extractor showing the knobs of the adjustable flow rate valves.

FIGS. 3 and 4 show each of the adjustable flow rate valves 211 in more detail. The valve 211 includes a generally cylindrical valve body 213 having an upstream housing 215 and a downstream housing 217 secured together by suitable fastening means such as screws. The upstream and downstream housings 215, 217 house a disc shaped valve plate 219 rotatably received therein. The upstream housing 215 includes a disc shaped base portion 223 having a raised hub portion 225 and an upstream inlet port 227 fluidly connected to one of the solution hoses 794, 798, 815, 823 via an elb formed rim 229 depends downstream from the base portion and fits around the valve plate 219 as seen in FIG. 4. Attached to the valve plate 219 and oriented perpendicular to the valve plate 219 is a cylindrical knob 231 that extends through the hub portion 225 of the upstream housing 215. The knob 231 further extends through an opening in the rear of the lower body portion 360 of the handle assembly 62 for access by a user as seen in FIG. 6. The knob 231 can be attached to the valve plate 219 by any suitable means such as, for example, gluing, welding, or integrally forming it with the valve plate 219. An arc shaped slot 233 (FIG. 3) is formed in the valve plate 219 and is aligned with the inlet port 227. The slot 233 is tapered along its length such that its cross sectional area increases going in the clockwise direction as seen in FIG. 3. Thus, the flow rate through the valve 211 increases when the valve plate 219 rotates a distance in the clockwise direction due to the larger portion of the groove 233 being aligned under the inlet port 227.

The downstream housing 217 includes a disc shaped base portion 235 and a rim 237 extending upstream that fits around the rim 229 of the upstream housing 215 as seen in FIG. 4. The base portion 235 includes a cylindrical pocket 239 at its hub that rotatably receives a tapered downstream portion of the knob 231. 0-rings 241, 243 are received in respective grooves in the knob 231 to seal the valve body 213 as seen in FIG. 4. The base portion 235 further includes a downstream outlet port 245 aligned with the inlet port 227 and a cylindrical camming projection 247 (FIG. 3) adjacent the outlet port 245 that extends through the slot 233. The projection 247 rides against the inner end 249 of the slot 233 as the valve plate 219 rotates, thereby guiding and aligning the slot 233 between the inlet port 227 and outlet port 245. The outlet port 245 fluidly connects to one of the solution hoses 794, 798, 815, and 823. To operate the valve, a user grasps the knob 231 and turns it to select one of several positions corresponding to different flow rates due to the different cross section area of the groove 233 aligned under the inlet port 227. These flow rates are used for various cleaning conditions.

Figure 7:
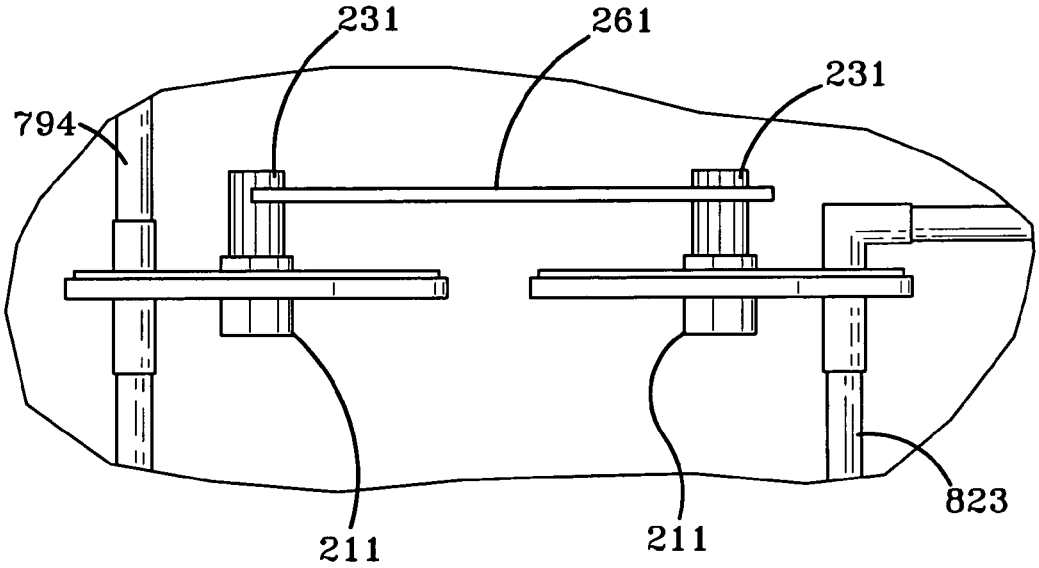
FIG. 7 is a fragmentary side view showing two adjustable flow rate valve rotatably connected by a coupling arm.

Further, with the valves 211 being strategically positioned in different solution hoses, the user can operate the carpet extractor 60 to distribute cleaning solution at a desired flow rate and/or a desired water and detergent mixing ratio for additional cleaning conditions as seen in FIG. 6. In particular, the valves 211 provided in the solution hoses 815 and 798 are used to adjust mixing ratio of clean water and detergent from all clean water for rinsing to all detergent. The valves 211 provided in the solution hoses 794 and 823 are used to adjust the flow rate of the cleaning solution. Thus, for example, the user can select a very high cleaning solution flow rate and a high concentration of detergent in the cleaning solution to clean very soiled or heavy traffic cleaning surfaces. In another example, a user can also select a low cleaning solution flow rate for a lightly soiled cleaning surface or for quick drying of the surface after use. Optionally as shown in FIG. 7, a mechanical connection such as a linking or coupling arm 261 rotatably connects the two knobs and/or valve plates 219 of the valves 211 in the solution hoses 794, 823 so that the user need only turn one of the knobs to select the cleaning solution flow rates for both of the valves 211. In particular, rotation of one knob causes the arm to rotate the other knob in a similar manner as that of the coupling rod that transfers rotational motion from the front wheel to the other rear wheels of a train engine. Additional coupling arms 261 can also be used to connect any two of the four valves 211.

Figure 5:
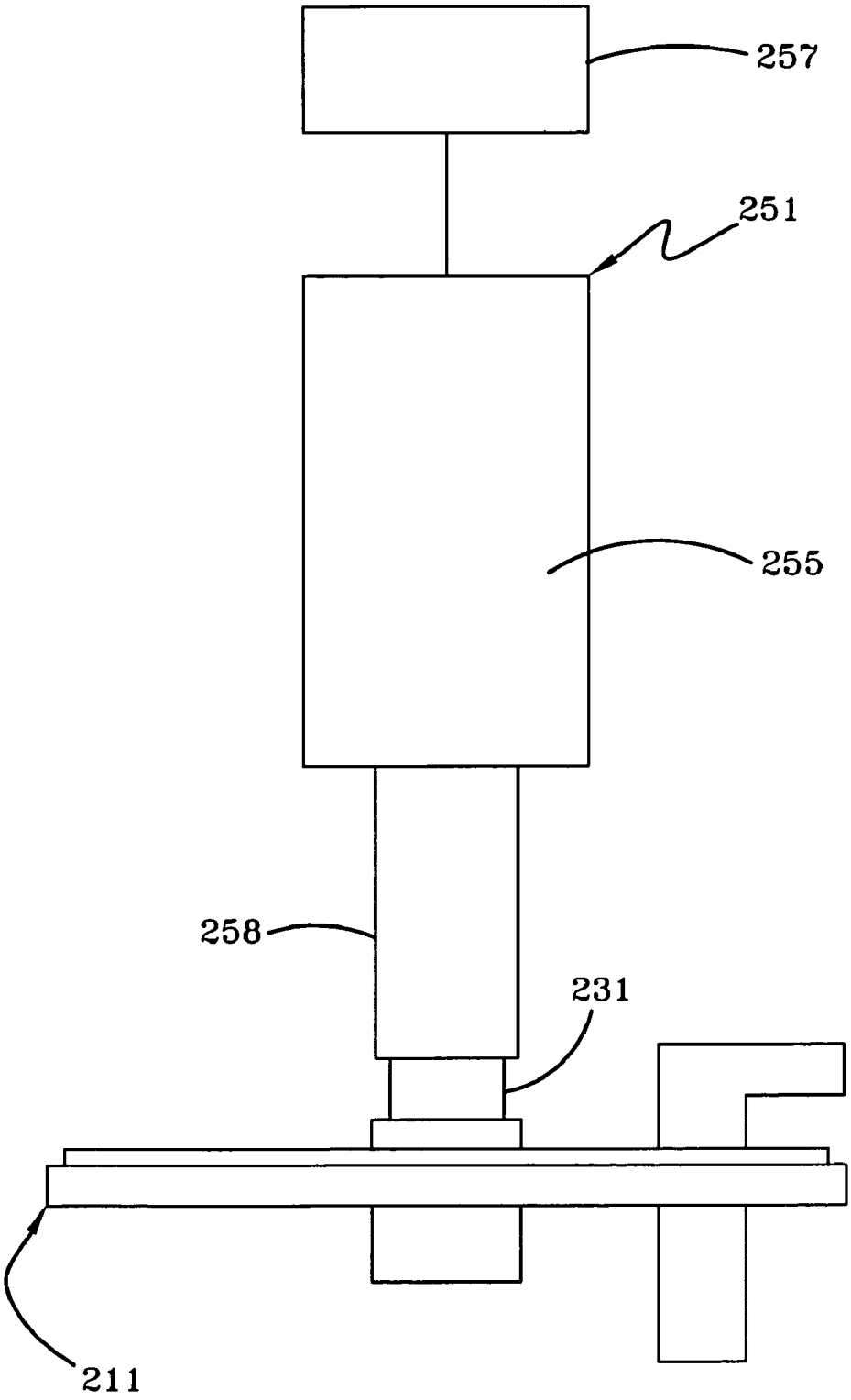
FIG. 5 is a schematic view of the adjustable flow rate valve being operated by a stepper motor.

Alternatively, as seen in FIG.5, each of the valves is operated electrically by a stepper motor assembly 251. In particular, the knob 231 is attached to a shaft 253 of a stepper motor 255 that is electrically connected to a multiple position switch 257. Each position of the switch 257 causes the stepper motor assembly 251 to rotate the valve plate 219 a distance to one of several positions corresponding to different flow rates. Other types of motors or devices could be used instead to rotate the valve part 219 such as, for example, a servomotor or a solenoid arrangement. Additionally, a touch screen or keypad device can operate the motor and valve via a microprocessor. The touch screen could have various operating mode and user information displayed in the form of alphanumeric and graphic light crystal displays (LCDs).

The shut off valves 800, 820 are operated by a trigger switch 821 as depicted in FIG. 1. The trigger switch 821 is pivotally connected to the upper handle portion 358 approximately near a closed looped handgrip 824. Slide switch 858 is used to select one of the shut off valve 800, 822 to be opened and closed by the trigger switch 821. Slide switch 856 is the main power switch, which turns on and off the suction motor 90 and pump 808. The cleaning solution containing the water or water mixed with detergent flows to their associated shut off valves 800, 820. The cleaning liquid distributor 792 evenly distributes the cleaning solution to each of the rotary scrub brushes 72. The scrub brushes 72 then spread the cleaning solution onto the carpet (or bare floor), scrub the cleaning liquid into the carpet and dislodge embedded soil. A solution discharge valve 877 allows the mixed detergent and clean water to flow through an integrally formed nipple 218 and a detachable solution tube 216 to a hand-held cleaning attachment (not shown) and dispense by typical spray means.

As is commonly known, a user pivots the handle 62 in an incline position while moving the carpet extractor 60 over the surface to clean it. The carpet extractor 60 distributes the cleaning solution to the carpeted surface using the brushes 72 and substantially simultaneously extracts it along with the dirt on the carpet in a continuous operation. In particular, soiled cleaning solution is extracted from the carpet via inlet 138 of the suction nozzle 124 and transported into the recovery tank 80 where the liquid and air are separated. A vacuum is created in the recovery tank 80 by the suction motor 90, which draws air from the recovery tank 80 and exhausts the air to the carpeted surface 74.

Any features shown in FIGS. 1-6, but not described herein, and further elements of the extraction cleaner, are disclosed in co pending application having Ser. No. 10/165,731; the disclosure being incorporated herein by reference. For example, elements disclosed in FIG. 6 but not described herein are shown in FIG. 24 of the above-mentioned pending application and described in that application.

Alternatively, the adjustable flow rate valve 211 could be placed in cleaning machine that has one solution tank such as that disclosed by previously mentioned U.S. Pat. No. 5,500,977. The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto.

In view of the above, it is intended that the present invention not be limited by the preceding disclosure of the embodiments, but rather be limited only by the appended claims.

What is claimed is:

1. A portable cleaning apparatus for cleaning a surface comprising:

a) a housing for movement along the cleaning surface;

b) a solution distribution system mounted at least in part to said housing and comprising:

a solution distribution system operatively connected to said housing for distributing a solution onto the cleaning surface;

a first solution tank for holding the solution;

a first adjustable flow rate valve having an inlet fluidly connected to said first solution tank and an outlet fluidly connected to said distributor for adjusting the flow rate of the solution out of said distributor, said first adjustable flow rate valve having a substantially planar rotating valve plate positioned between said inlet and said outlet, said planar valve plate having a variable flow rate slot disposed through said valve plate, said slot allowing said solution to pass between said inlet and said outlet;

a knob secured to said valve plate, wherein rotating said knob rotates both said planar valve plate and said slot between said inlet and said outlet wherein the position of said slot determines the flow rate of the solution through said first adjustable flow rate valve;

a second adjustable flow rate valve operatively associated with said first solution tank and said distributor for adjusting the flow rate of the solution out of said distributor, said second adjustable flow rate valve having a valve part, and a coupling member operatively connected between said valve part of said second adjustable flow rate valve and one of said knob and said valve plate of said first adjustable flow rate valve such that movement of said selector causes said coupling member to move said valve part of said second adjustable flow rate valve such that the flow rate of the solution through said second adjustable flow rate valve is dependent on the position of said valve part of said second adjustable flow rate valve.

2. A portable cleaning apparatus for cleaning a surface comprising:

a) a housing for movement along the cleaning surface;

b) a solution distribution system mounted at least in part to said housing and comprising:

a solution distribution system operatively connected to said housing for distributing a solution onto the cleaning surface;

a first solution tank for holding the solution;

a first adjustable flow rate valve having an inlet fluidly connected to said first solution tank and an outlet fluidly connected to said distributor for adjusting the flow rate of the solution out of said distributor, said first adjustable flow rate valve having a substantially planar rotating valve plate positioned between said inlet and said outlet, said planar valve plate having a variable flow rate slot disposed through said valve plate, said slot allowing said solution to pass between said inlet and said outlet;

a knob secured to said valve plate, wherein rotating said knob rotates both said planar valve plate and said slot between said inlet and said outlet wherein the position of said slot determines the flow rate of the solution through said first adjustable flow rate valve;

a second solution tank for holding clean water, said first solution tank holding a detergent solution, a mixing chamber connected between said first and second solution tanks for mixing the clean water and detergent solution, said inlet of said first adjustable flow valve fluidly connected to said mixing chamber at a location downstream of said mixing chamber for adjusting the flow rate of the solution out of said mixing chamber.

3. A portable cleaning apparatus for cleaning a surface comprising:

a) a housing for movement along the cleaning surface;

b) a solution distribution system mounted at least in part to said housing and comprising:

a solution distributor operatively connected to said housing for distributing a solution onto the cleaning surface;

a solution tank for holding the solution;

a first adjustable flow rate valve operatively associated with said first solution tank and said distributor for adjusting the flow rate of the solution out of said distributor, said first adjustable flow rate valve having a valve part;

a second adjustable flow rate valve operatively associated with said first solution tank and said distributor for adjusting the flow rate of the solution out said distributor, said second adjustable flow rate valve having a valve part;

a user operated selector operatively connected to said valve part of said first adjustable flow rate valve, wherein moving said selector moves said valve part of said first adjustable flow rate valve such that the flow rate of the solution through said first adjustable flow rate valve is dependent on the position of said valve part of said first adjustable flow rate valve; and a coupling member operatively connected between said valve part of said second adjustable flow rate valve and one of said selector and said valve part of said first adjustable flow rate valve such that movement of said selector causes said coupling member to move said valve part of said second adjustable flow rate valve such that the flow rate of the solution through said second adjustable flow rate valve is dependent on the position of said valve part of said second adjustable flow rate valve.

4. The portable cleaning apparatus of claim 3 including a recovery system comprising:

a recovery tank mounted on the housing for holding recovered dirt and the cleaning solution, a suction nozzle operatively connected to said housing and in fluid communication with said recovery tank for transporting the cleaning solution and dirt recovered from said cleaning surface to said recovery tank, a suction source in fluid communication with said suction nozzle and recovery tank for drawing the cleaning solution and dirt from the cleaning surface through the suction nozzle and to the recovery tank.

5. The portable cleaning apparatus of claim 4 wherein said housing includes a base and a handle pivotally connected to said base, said recovery tank being removably mounted to said housing, said solution tank being removably mounted to said housing.

6. The portable cleaning apparatus of claim 3 including a motor assembly operatively connected to said valve part of said first adjustable flow rate valve for rotating said valve part to selected distances.

7. A portable cleaning apparatus for cleaning a surface comprising:

a) a housing for movement along the cleaning surface;

b) a solution distribution system mounted at least in part to said housing and comprising:

a solution distributor operatively connected to said housing for distributing a solution onto the cleaning surface;

a first solution tank for holding a first solution;

a second solution tank for holding a second solution;

a mixing chamber fluidly connected between said first and second solution tanks for mixing the first and second solutions;

a first adjustable flow rate valve operatively associated with said mixing chamber and said distributor for adjusting the flow rate of the solution out of said mixing chamber, said first adjustable flow rate valve having a valve part;

a second adjustable flow rate valve operatively associated with said first solution tank and said mixing chamber for adjusting the flow rate of the first solution from said first solution tank and thereby varying the relative proportions of the first solution and the second solution flowing out of said mixing chamber; and a user operated selector operatively connected to said valve part of said first adjustable flow rate valve, wherein moving said selector moves said valve part such that the flow rate of the solution through said first adjustable flow rate valve is dependent on the position of said valve part of said first adjustable flow rate valve;

wherein said second adjustable flow rate valve has a valve part, a coupling member operatively connected between said valve part of said second adjustable flow rate valve and one of said selector and said valve part of said first adjustable flow rate valve such that movement of said selector causes said coupling member to move said valve part of said second adjustable flow rate valve such that the flow rate of the solution through said second adjustable flow rate valve is dependent on the position of said valve part of said second adjustable flow rate valve.

8. A portable cleaning apparatus for cleaning a surface comprising:

a) a housing for movement along the cleaning surface;

b) a solution distribution system mounted at least in part to said housing and comprising:

a solution distributor operatively connected to said housing for distributing a solution onto the cleaning surface;

a first solution tank for holding a first solution:

a second solution tank for holding a second solution;

a mixing chamber fluidly connected between said first and second solution tanks for mixing the first and second solutions;

a first adjustable flow rate valve operatively associated with said mixing chamber and said distributor for adjusting the flow rate of the solution out of said mixing chamber, said first adjustable flow rate valve having a valve part; and a second adjustable flow rate valve operatively associated with said first solution tank and said mixing chamber for adjusting the flow rate of the first solution from said first solution tank and thereby varying the relative proportions of the first solution and the second solution flowing out of said mixing chamber;

wherein said first adjustable flow rate valve has an inlet fluidly connected to said mixing chamber and an outlet fluidly connected to said distributor, said valve part of said first adjustable flow rate valve has a variable flow rate slot, a knob secured to said rotating valve part, wherein rotating said knob rotates said valve part and said slot such that the flow rate through said first adjustable flow rate valve is dependent on the position of said slot between said inlet and said outlet of said valve part.

9. The portable cleaning apparatus of claim 8 wherein said slot is tapered along the length thereof.

10. The portable cleaning apparatus of claim 7 including a recovery system comprising:

a recovery tank mounted on the housing for holding recovered dirt and the cleaning solution, a suction nozzle operatively connected to said housing and in fluid communication with said recovery tank for transporting the cleaning solution and dirt recovered from said cleaning surface to said recovery tank, a suction source in fluid communication with said suction nozzle and recovery tank for drawing the cleaning solution and dirt from the cleaning surface through the suction nozzle and to the recovery tank.

11. The portable cleaning apparatus of claim 10 wherein said recovery tank is removably mounted to said housing and at least said first solution tank is removably mounted to said housing.

12. A portable cleaning apparatus for cleaning a surface comprising:

a) a housing for movement along the cleaning surface;

b) a solution distribution system mounted at least in part to said housing and comprising:

a solution distributor operatively connected to said housing for distributing a solution onto the cleaning surface;

a first solution tank for holding a first solution;

a second solution tank for holding a second solution;

a mixing chamber fluidly connected between said first and second solution tanks for mixing the first and second solutions;

a first adjustable flow rate valve operatively associated with said mixing chamber and said distributor for adjusting the flow rate of the solution out of said mixing chamber, said first adjustable flow rate valve having a valve part;

a second adjustable flow rate valve operatively associated with said first solution tank and said mixing chamber for adjusting the flow rate of the first solution from said first solution tank and thereby varying the relative proportions of the first solution and the second solution flowing out of said mixing chamber; and a motor assembly operatively connected to said valve part of said first adjustable flow rate valve for rotating said valve part to selected distances.

13. A portable cleaning apparatus for cleaning a surface comprising:

a) a housing for movement along the cleaning surface;

b) a solution distribution system mounted at least in part to said housing and comprising:

a solution distribution system operatively connected to said housing for distributing a solution onto the cleaning surface;

a first solution tank for holding the solution:

a first adjustable flow rate valve having an inlet fluidly connected to said first solution tank and an outlet fluidly connected to said distributor for adjusting the flow rate of the solution out of said distributor, said first adjustable flow rate valve having a substantially planar rotating valve plate positioned between said inlet and said outlet, said planar valve plate having a variable flow rate slot disposed through said valve plate, said slot tapered along its length allowing said solution to pass between said inlet and said outlet, wherein said tapered slot in the valve plate is tapered such that the cross sectional area of the slot increases in a clockwise direction for a valve plate that rotates a distance in the clockwise direction where said slot is aligned between the inlet and outlet for fluid connection allowing for different flow rates with the different cross sectional areas of the slot aligned under the inlet; and a knob secured to said valve part, wherein rotating said knob rotates both said planar valve plate and said slot between said inlet and said outlet wherein the position of said slot determines the flow rate of the solution through said first adjustable flow rate valve.

14. The portable cleaning apparatus of claim 3 wherein said movable valve part of the first adjustable flow rate valve has a slot tapered along its length such that the cross sectional area of the slot increases as the valve part moves such that said slot aligned between the inlet and outlet for fluid connection allows for different flow rates with the different cross sectional areas of the slot aligned under the inlet.

15. The portable cleaning apparatus of claim 13 wherein said first adjustable flow rate valve has the substantially planar rotating valve plate positioned between said inlet and said outlet, wherein the valve plate is between an upstream housing having an inlet port and a downstream housing having an outlet port where the slot is aligned with the inlet and outlet ports and where the upstream housing has a hub portion for accommodating the knob and the downstream housing has a base portion with a pocket at its hub that rotatably receives a downstream portion of the knob so that the knob can rotate the planar valve plate having the variable flow rate slot disposed through said valve plate, wherein the slot tapered along its length for allowing said solution to pass between said inlet and said outlet.

* * * * *

UNITED STATES PATENT AND TRADEMARK OFFICE

CERTIFICATE OF CORRECTION

PATENT NO. : 7,624,473 B2
APPLICATION NO. : 10/753017
DATED : December 1, 2009
INVENTOR(S) : Kegg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 730 days.

Signed and Sealed this

Twenty-sixth Day of October, 2010

David J. Kappos

David J. Kappos
*Director of the United States Patent and Trademark Office*